United States Patent [19]

Arai et al.

[11] Patent Number: 4,459,538

[45] Date of Patent: Jul. 10, 1984

[54] POWER SUPPLY CIRCUIT

[75] Inventors: Youichi Arai, Machida; Masayuki Takagi, Kawasaki, both of Japan

[73] Assignee: Fujitsu Limited, Kawasaki, Japan

[21] Appl. No.: 390,874

[22] Filed: Jun. 22, 1982

[30] Foreign Application Priority Data

Jul. 3, 1981 [JP] Japan ..... 56-104019

[51] Int. Cl.[3] ..... G05F 1/48

[52] U.S. Cl. ..... 323/275; 323/267; 323/349

[58] Field of Search ..... 323/273, 274, 275, 349, 323/303, 267

[56] References Cited

U.S. PATENT DOCUMENTS 3,588,675 6/1971 Suzuki ..... 323/275 X 3,983,473 9/1976 Sanderson ..... 323/267 X 4,325,021 4/1982 McMackin ..... 323/351

*Primary Examiner*—Peter S. Wong

*Attorney, Agent, or Firm*—Staas & Halsey

[57] ABSTRACT

A power supply circuit which comprises a first power source terminal for applying a plus voltage and a second power source terminal for applying a minus voltage. A first transistor is inserted between the first power source terminal and a load. A second transistor is inserted between a base of the first transistor and a ground potential and is controlled by the voltages applied to the first and second power source terminals. A capacitor is connected to the second power source and ground potential. A sequence of applying or cutting-off voltages to be applied to the load is predetermined even when a sequence of applying or cutting-off the voltages from said first and second power source terminals becomes erratic.

8 Claims, 14 Drawing Figures

POWER SUPPLY CIRCUIT

BACKGROUND OF THE INVENTION

The present invention relates to a power supply circuit, and more particularly to a voltage selector circuit in the case of operating drive (or measured) means with a plurality of power sources.

In a magnetic recording/reproducing apparatus etc., a plurality of power sources of, e.g., +12 V and +5 V have heretofore been used in a circuit for moving the magnetic head of a magnetic disk device and for pressing the magnetic head against a magnetic disk, etc.

To this end, two voltage sources have been employed. When the respective voltages rise due to the turning ON or OFF of a power supply, writing or reading errors might occur depending upon whether the circuit for pressing the magnetic head operates earlier or later.

In the case of driving or measuring a field-effect transistor (FET), such as a GaAs FET or the like, with a plurality of power sources, a first voltage source connected to the drain of the FET and a second voltage source connected to the gate thereof must be applied or cut off in a predetermined sequence. More specifically, in turning off the power supply, the second voltage source is turned "on" to apply a bias voltage to the gate electrode of the FET, and the first voltage source is subsequently turned "on" to apply a bias to voltage the drain electrode thereof. In turning on the power supply, the bias voltage applied to the drain electrode is rendered "off" and thereafter, the bias voltage applied to the gate electrode is rendered "off." Otherwise, the FET will breakdown. In order to prevent breakdown of the FET, switching operations at the turning off or turning on of the power supply have been scrupulously performed. Alternatively, a sequencer circuit has been assembled of a relay, etc., so that the respective voltages may rise or fall in a predetermined sequence when the power supply is turned off or turned on. The addition of the relay, etc., to the power supply circuit of this type, however, incurs the disadvantages of being a large-sized power supply device, having low circuit reliability and having a high cost.

SUMMARY OF THE INVENTION

An object of the present invention is to provide a power supply circuit which is free from the disadvantages stated above.

The present invention is a power supply circuit in which, even when the sequence of applying or interrupting voltages from a plurality of voltage sources becomes erratic, it is ensured that a first or second driving (or measuring) element for the drive (or measured) means is operated after the second or first driving (or measuring) element has been operated.

The present invention comprises a power supply circuit having a first power source terminal;

a second power source terminal having an applied voltage opposite in sign to a voltage applied to the first power source terminal;

a first switching element which is inserted in series between the first power source terminal and a load;

a second switching element which is inserted between a base of the first switching element and a reference potential and which is controlled by the voltages applied to the first and second power source terminals; and a capacitive element which is connected between a second power source and the reference potential, control voltages being applied to the second switching element from the first and second power sources, so that a sequence of applying or interrupting voltages to be applied to the load is predetermined even when the sequence of applying or interrupting the voltages of the first and second power source terminals becomes erratic.

DESCRIPTION OF THE PREFERRED EMBODIMENTS

Hereafter, embodiments of the present invention will be described in detail with reference to the drawings.

Figure 1A:
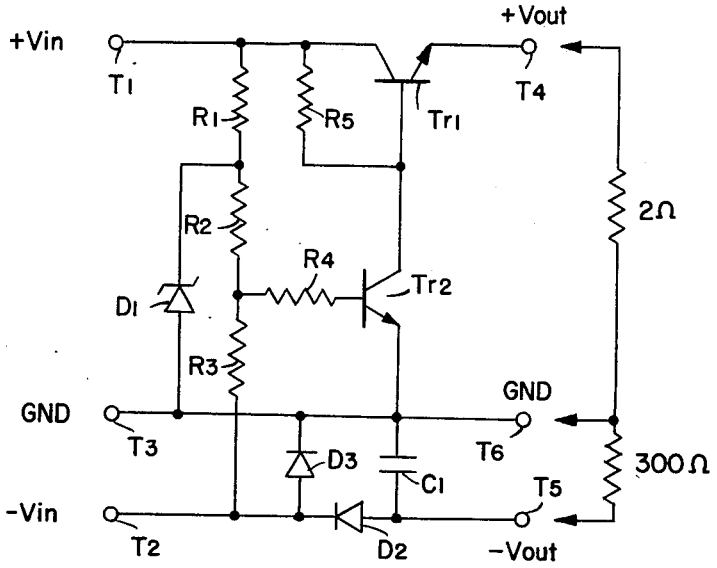
FIG. 1A is circuit diagram of a power supply circuit of an embodiment of the present invention.

FIG. 1A shows the fundamental circuit arrangement of the present invention. Terminals $T_1$, $T_2$ and $T_3$ are input terminals. A voltage on the order of $+V_{in}=+15$ V is applied across the plus input terminal $T_1$ and the reference or constant potential terminal, for example, the ground terminal $T_3$, while a voltage on the order of $-V_{in}=-6$ V is applied across the minus input terminal $T_2$ and the ground terminal $T_3$.

Terminals $T_4$, $T_5$ and $T_6$ are output terminals. The voltage of the plus output terminal $T_4$ relative to the ground terminal $T_6$ is applied to, e. g., a drain exhibiting a comparatively low impedance, while the voltage of the minus output terminal $T_5$ relative to the ground terminal $T_6$ is applied to, e. g. a gate exhibiting a comparatively high impedance.

Figure 1B:
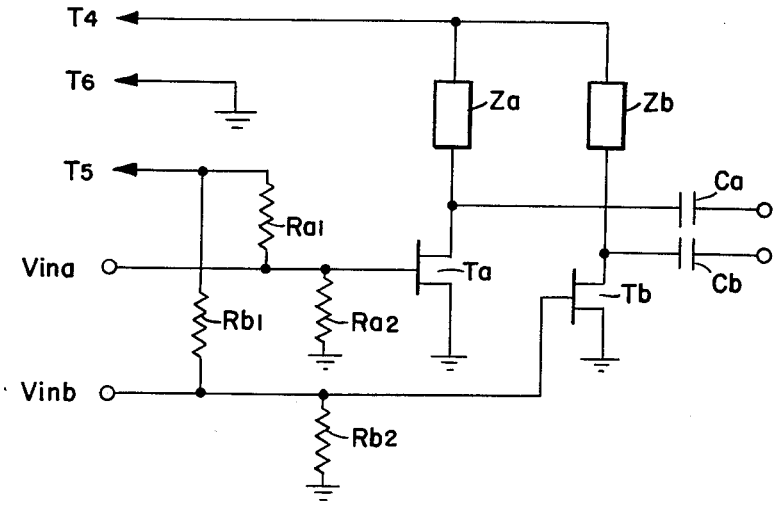
FIG. 1B is an amplifying circuit to be connected to the output terminals of the power supply circuit of FIG. 1A.

FIG. 1B shows an example of an amplifying circuit to be connected to the output terminals $T_4$, $T_5$ and $T_6$ of the circuit arrangement shown in FIG. 1A. The minus output voltage $-V_{out}$ is supplied from the terminal $T_5$ and is divided by resistors $Ra_1$ and $Ra_2$, and resistors $Rb_1$ and $Rb_2$, thereby providing the gate bias voltages of GaAs field effect transistors Ta and Tb, respectively. The plus output voltage $+V_{out}$ is applied to the drains of the transistors Ta and Tb through impedance elements Za and Zb, respectively. When the a.c. input signals $V_{ina}$ and $V_{inb}$ are applied to the amplifying circuits, the input signals are amplified through the transistor Ta and impedance element Za, and the transistor Tb and impedance Zb, respectively, thereby producing the output signals from the amplifying circuit through coupling condensers Ca and Cb.

An impedance component or a d.c. equivalent circuit of the amplifying circuit of FIG. 1B is Shown in FIG. 1A by the resistors having the value of 2Ω and 300Ω. In FIG. 1A, the resistor of 2Ω represents the impedance between the drains of the transistors Ta and Tb and ground. The resistor of 300Ω represents the impedance between the gates of the transistors and ground.

The plus input and output terminals $T_1$ and $T_4$ are connected through the collector-emitter path of a first transistor $Tr_1$, the base of which is connected to the ground potential through the collector-emitter path of a second transistor $Tr_2$. A resistor $R_5$ is connected between the base and collector of the first transistor $Tr_1$. A series circuit comprising resistors $R_1$, $R_2$ and $R_3$ is connected between the plus input terminal $T_1$ and the minus input terminal $T_2$, and a resistor $R_4$ is connected between the node of the resistors $R_2$ and $R_3$ and the base of the second transistor $Tr_2$, so that the plus input voltage $+V_{in}$ is applied to the base of the second transistor $Tr_2$ through the resistors $R_1$, $R_2$ and $R_4$ and the minus input voltage $-V_{in}$ is applied thereto through the resistors $R_3$ and $R_4$.

A Zener diode $D_1$, for setting a reference voltage, is connected between the node of the resistors $R_1$ and $R_2$ and ground. Further, the minus input terminal $T_2$ is connected to the minus output terminal $T_5$ through a first diode $D_2$. Still further, a second diode $D_3$ and a capacitor $C_1$ are respectively inserted and connected between the corresponding terminals of the first diode $D_2$ and ground.

Figure 5A:
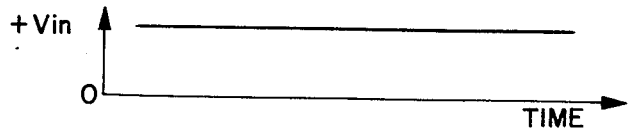
FIGS. 5A to 5D are waveform diagrams for explaining the operations of the power supply circuit in FIGS. 1 to 4.

The operation of the circuit arrangement in FIG. 1 will be described with reference to wave forms depicted in FIGS. 5A–5D. When the d.c. voltage $+V_{in}$ as shown in FIG. 5A is first applied from a first voltage source (not shown) to the plus input terminal $T_1$, the second transistor $Tr_2$ has its base supplied with the plus voltage through the resistors $R_1$, $R_2$ and $R_4$ and therefore is in the "on" state. The base potential of the first transistor $Tr_1$ becomes a low potential, and is therefore in an "off" state.

Figure 5B:
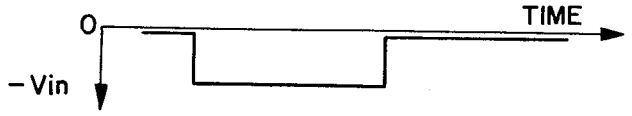
Figure 5C:
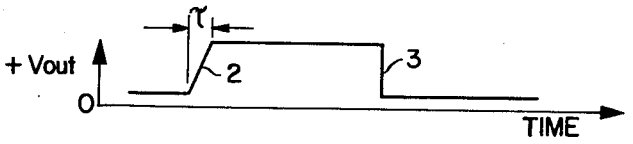
Figure 5D:
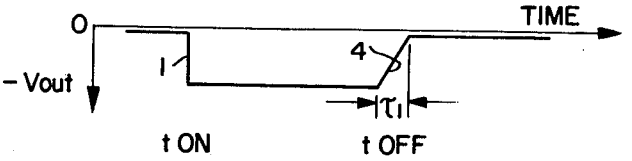

When, in the above state, the minus voltage $-V_{in}$ is applied from a second voltage source (not shown) as depicted in FIG. 5B, the minus output terminal $T_5$ is supplied with the minus output voltage through the diode $D_2$ without a time delay as seen from the falling edge 1 in FIG. 5D. On account of a voltage drop across the diode $D_2$, the voltage $-V_{in}=-6$ V applied to the minus input terminal $T_2$ appears as the minus voltage $-V_{out}=-5.3$ V at the minus output terminal $T_5$. At this point in time, the second transistor $Tr_2$ which is in the "on" state has the minus voltage $-V_{in}$ applied to its base through the resistors $R_3$ and $R_4$ and is therefore inverted into an "off" state. Then, the first transistor $Tr_1$ is supplied with the plus voltage $+V_{in}$ through the resistor $R_5$ and turns "on", so that the plus voltage $+V_{out}=14.3$ V is delivered to the plus output terminal $T_4$ as the plus input voltage $+Vin=15$ V. A rising waveform in this state is depicted by a rising edge 2 in FIG. 5C. In this case, a time delay $\tau$, which is determined by the stray capacitances of the first and second transistors $Tr_1$ and $Tr_2$ and the resistances of the bias resistors, occurs.

As thus far described, the minus voltage $-V_{out}$ is provided at the minus output terminal $T_5$, to which the gate electrode of an FET or the like is connected, immediately without any time delay or simultaneously with the application of the second voltage source. Accordingly, the gate electrode is supplied with the voltage.

Subsequently, the plus voltage $+V_{out}$ is provided to the plus output terminal $T_4$, to which the drain electrode of the FET or the like is connected, with the time delay $\tau$. Even when the plus voltage $+V_{in}$ has been applied, the first transistor $Tr_1$ is in the nonconductive state and delivers no output voltage to the plus output terminal $T_4$. In this manner, irrespective of the sequence of applying the voltages from the first and second voltage sources, the output voltages with the time delay and in the desired sequence are provided to the minus output terminal and the plus output terminal without fail.

Now, a case of interrupting the voltages from the first and second voltage sources will be described with reference to FIGS. 5A–5D.

Let's consider a case where, in the state in which the plus voltage $+V_{in}$ and the minus voltage $-V_{in}$ depicted in FIGS. 5A and 5B are applied, the latter voltage applied to the minus input terminal $T_2$ is interrupted. In this case, the minus voltage applied to the base of the second transistor $Tr_2$ which is in the "off" state is removed, so that the plus voltage applied to the plus input terminal $T_1$ is impressed on the base of the second transistor $Tr_2$ through the resistors $R_1$, $R_2$ and $R_4$ to turn the second transistor "on". The first transistor $Tr_1$, accordingly, has its base grounded through the second transistor $Tr_2$ and turns "off", with the result that the voltage of the plus output terminal $T_4$ falls abruptly. A falling edge 3 shown in FIG. 5C involves a time delay under the influence of the stray capacitances of the first and second transistors $Tr_1$ and $Tr_2$ and the bias resistors. Since, however, the impedance of the drain of the FET element connected to the plus output terminal $+V_{out}$ is small, about 2Ω, the aforementioned time delay is much smaller than a time delay at the minus output terminal $-V_{out}$ to be described later. The falling edge 3 is therefore illustrated as having no time delay On the other hand, the side of the minus output terminal $T_5$ to which the gate electrode of the FET is connected has an impedance of 300Ω, which is 150 times greater than the impedance of the drain mentioned above. As shown by a rising part 4 in FIG. 5D, therefore, the voltage of the minus output terminal $T_5$ rises with a large time delay $\tau$ in accordance with a time constant which is determined by the impedance of the gate and the capacitance of the capacitor $C_1$ 2–3 μF.

In the interrupting operation, therefore, the FET has its drain side turned "off" a predetermined time earlier than its gate side, without fail. Accordingly, the FET is prevented from breaking down.

In FIG. 1, the Zener diode $D_1$, for setting the reference voltage, is disposed in order to prevent instability attributed to fluctuations in the bias voltage applied to the second transistor $Tr_2$, and it holds the potential between the node of the resistors $R_1$ and $R_2$ and ground at 10 V or so. The diode $D_3$ grounds the bias voltage of the plus input voltage $+V_{in}$ along with the resistors $R_1$, $R_2$ and $R_3$, and upon application of the minus input voltage $-V_{in}$, it also prevents the minus input voltage from being grounded.

Further, the diode $D_2$ prevents the plus voltage from outputting to the minus output terminal $T_5$ when the minus input voltage-Vin is not applied to the terminal $T_2$. The diode $D_2$ also prevents the discharge of the electric charge stored in the capacitor $C_1$ through the terminals $T_3$ and $T_2$ when the input voltage $-V_{in}$ is at ground potential.

A second embodiment of the present invention will now be described in detail with reference to FIG. 2. The of difference is the addition of a pulse supplying circuit PS enclosed with a dotted line. The other elements are the same as in FIG. 1 and the same portions are assigned the same symbols and will not be explained again. A plus pulse voltage $+V_p$ is impressed on the base of a third transistor $Tr_3$ through a resistor $R_6$. One end of a resistor $R_7$ is connected between the resistor $R_6$ and a pulse input terminal $T_7$, while the other end thereof is connected to the ground terminal $T_6$. The collector of the third transistor $Tr_3$ is connected to the base of the first transistor $Tr_1$, and the emitter thereof is grounded.

Figure 6A:
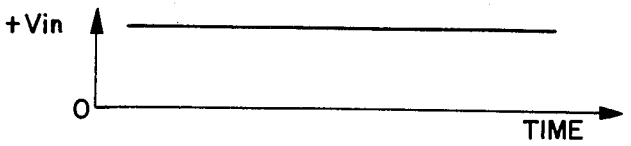
FIGS. 6A to 6E are waveform diagrams for explaining the operations of the power supply circuits in FIGS. 2 and 4.
Figure 6B:
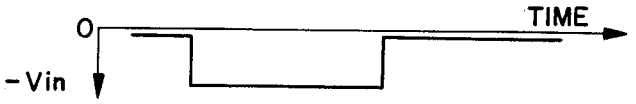

In the above arrangement, by way of example, a d.c. component of a waveform as shown in FIG. 6A is applied to the plus input terminal $T_1$, and a minus voltage as shown in FIG. 6B is applied to the minus input terminal $T_2$. Then, output voltages at the minus output terminal $T_5$ and the plus output terminal $T_4$ rise (1) and fall (2), respectively as illustrated in FIGS. 6D and 6E. At this time, the plus output voltage $+V_{out}$ becomes steady state after the delay of a time interval $\tau$.

Figure 6C:
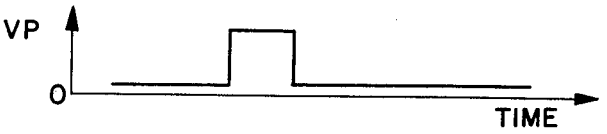
Figure 6D:
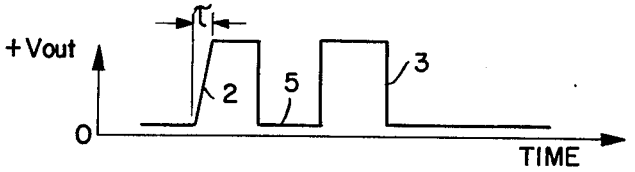
Figure 6E:
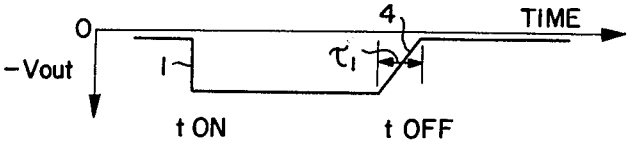

Here, in the present invention, the pulse voltage $+V_p$ is applied from the pulse input terminal $T_7$ as shown in FIG. 6C. Then, the third transistor $Tr_3$ has its base supplied with a plus voltage through the resistor $R_6$ and turns "on". The first transistor $Tr_1$ has its base grounded through the third transistor $Tr_3$ and is turned "off" state. As shown by waveform 5 in FIG. 6D, the plus output terminal $T_4$ provides substantially no voltage. The operation, in the case of interrupting the minus input voltage $-V_{in}$, is the same as described with reference to FIG. 1, and is omitted from the description.

Figure 2:
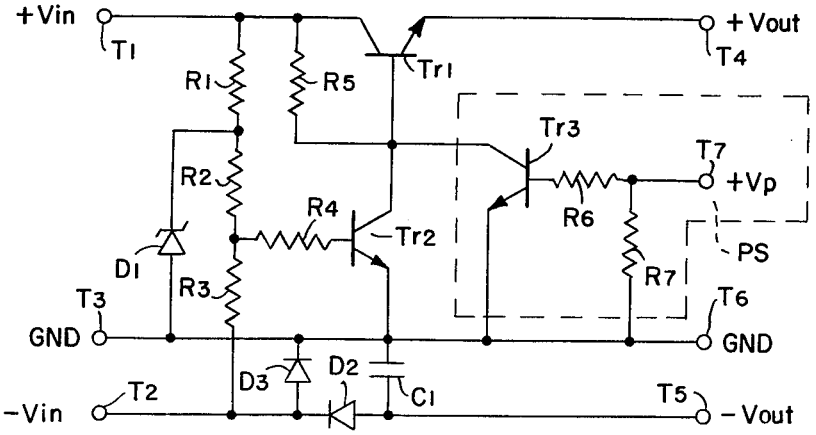
FIG. 2 is a circuit diagram of a second embodiment of the present invention.

According to the arrangement shown in FIG. 2, as illustrated in FIGS. 6C and 6D, in the period of time during which the plus output voltage $+V_{out}$ is unnecessary, the pulse input voltage $+V_p$ is impressed so as to deliver no voltage to the plus output terminal $T_4$. Therefore, the efficiency of the power supply can be enhanced.

In FIG. 2, the resistor $R_7$ is connected for stability in the case where the pulse voltage $+V_p$ is not impressed.

Figure 3:
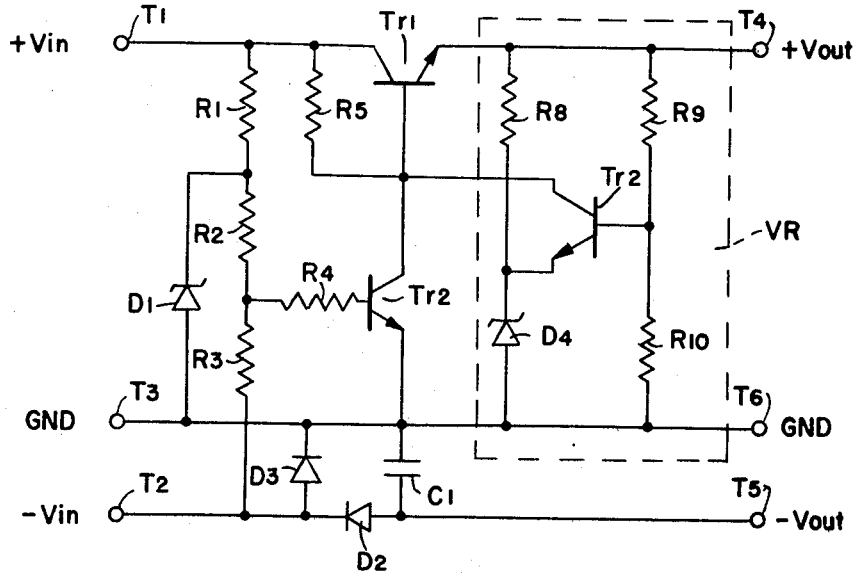
FIG. 3 is a circuit diagram of a third embodiment of the present invention.

FIG. 3 shows a third embodiment of the present invention, in which a voltage regulator circuit VR, indicated by a dotted line, is added. More specifically, a series circuit comprising resistors $R_9$ and $R_{10}$ for voltage division a series circuit comprising resistor $R_8$, and a Zener diode $D_4$ for providing a reference voltage are respectively connected between the ground terminal and a line connecting the emitter of the first transistor $Tr_1$ and the plus output terminal $T_4$. The base of a fourth transistor $Tr_4$ is connected to the node of the resistors $R_9$ and $R_{10}$, and the emitter thereof is connected to a node of the resistor $R_8$ and the Zener diode $D_4$.

In the above arrangement, in the state in which the plus output voltage $+V_{out}$ and the minus output voltage $-V_{out}$ are delivered, the first transistor $Tr_1$ is in the "on" state and the base of the fourth transistor $Tr_4$ is supplied with a voltage which is determined by the voltage division ratio of the resistors $R_9$ and $R_{10}$. In the case where the divided output voltage is greater than the reference voltage of the Zener diode $D_4$, in excess of a predetermined value, the fourth transistor $Tr_4$ turns "on" and the first transistor $Tr_1$ turns into the "off" state, so that the plus output terminal $T_4$ is held at the predetermined voltage. As compared with the arrangement shown in FIG. 1, therefore, this embodiment can regulate the plus output voltage $+V_{out}$.

Figure 4:
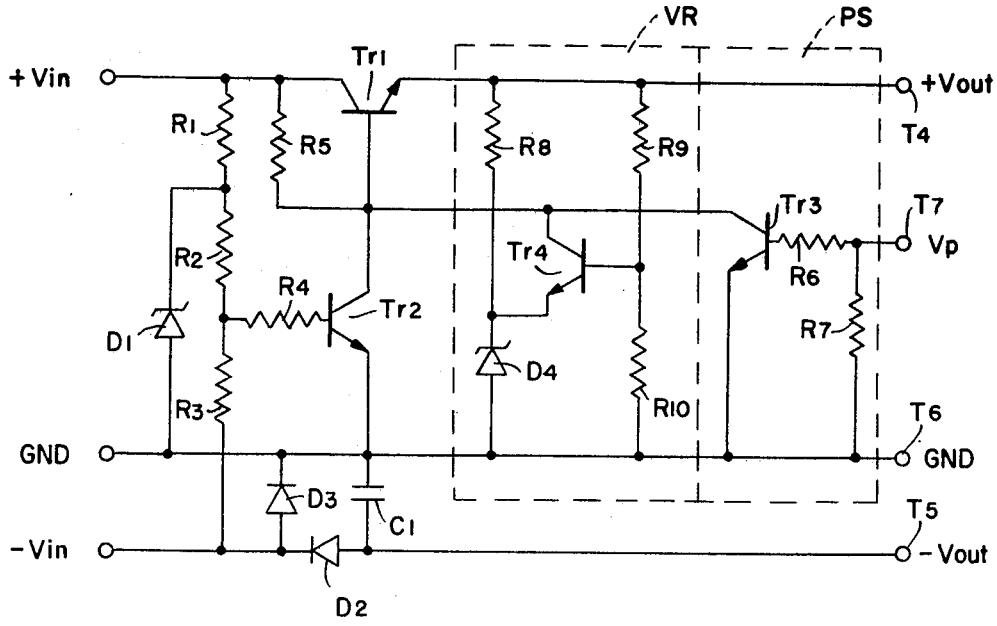
FIG. 4 is a circuit diagram of a fourth embodiment which is similar to the embodiment of FIG. 1, but to which a pulse supplying circuit in FIG. 2 and a voltage regulator circuit in FIG. 3 are added.

FIG. 4 shows a fourth embodiment of the present invention, in which the pulse supplying circuit PS shown in FIG. 2 and the voltage regulator circuit VR shown in FIG. 3 are added to the circuit arrangement of FIG. 1.

The value of the resistors used in FIGS. 1A-4 are, for example, as follows: $R_1=150\Omega$, $R_2=1200\Omega$, $R_3=430\Omega$, $R_4=510\Omega$, $R_5=200\Omega$, $R_6=1K\Omega$, $R_7=1K\Omega$, $R_8=390\Omega$, $R_9=300\Omega$, $R_{10}=680\Omega$.

The transistors $Tr_1$ to $Tr_4$ may be formed by field effect transistors and then, the gate of the FET will correspond to the base of each of the transistors $Tr_1$ to $Tr_4$.

Since the present invention is constructed as described above, the destruction of an element is not incurred and errors in the operations of a drive means etc. can be prevented even when the sequence of applying or interrupting voltages from two voltage sources has been disordered.

Further, the efficiency can be enhanced by providing a constant output voltage only during the period of time when the voltage is necessary. The present invention has numerous merits.

We claim:

1. A power supply circuit, comprising:

a first power source terminal operatively connected to receive a first voltage, said first voltage being a positive voltage;

a second power source terminal operatively connected to receive a second voltage opposite in polarity to said first voltage applied to said first power source terminal;

a reference terminal operatively connected to receive a reference voltage;

a load operatively connected to said first power source terminal;

a plurality of resistors, operatively connected in series between said first and second power source terminals;

first and second one directional elements operatively connected to each other, said first one-directional element operatively connected to said second power source terminal and said second one-directional element operatively connected to said reference terminal;

first and second output terminals, said second output terminal operatively connected to said second one directional element and said first output terminal operatively connected to said first power source terminal;

a first switching element having a first control terminal, operatively connected in series with said first power source terminal;

a second switching element having a second control terminal operatively connected to said plurality of resistors, operatively connected between said first control terminal of said first switching element and said reference terminal, said second switching element controlled by said first and second voltages applied to said first and second power source terminals, respectively, such that after said second voltage is applied to said second power source terminal, said second switching element provides a signal to said first control terminal for turning on said first switching element, such that after said second voltage is cut-off from said second power source terminal, said second switching element provides a signal to said first control terminal so as to turn off said first switching element before the voltage level of said second output terminal rises to the reference voltage, and such that when said second voltage is applied to said second output terminal before said first voltage is applied to said first output terminal, said first voltage is cut-off from said first output terminal before said second voltage is cut-off from said second output terminal independent of when said first and second voltages are applied or cut-off from said first and second power source terminals, respectively; and a capacitive element operatively connected between said second power source terminal and said reference terminal.

2. A power supply circuit according to claim 1, wherein said first and second switching elements each comprise a transistor and wherein the reference potential is ground voltage.

3. A power supply circuit according to claim 1, wherein the power supply circuit is operatively connectable to receive an external voltage, further comprising a third switching element having a third control terminal operatively connected to said first control terminal of said first switching element, thereby performing an ON or OFF operation of said first voltage from said first power source terminal by applying the external voltage to said third control terminal of said third switching element.

4. A power supply circuit according to claim 1, further comprising an output terminal and a voltage regulator circuit, said voltage regulator circuit operatively connected in parallel with said first and second switching elements, for supplying a constant voltage to said output terminal.

5. A power supply circuit according to claim 1, operatively connectable to receive an external voltage, further comprising:

a pulse input terminal, operatively connected to receive the external voltage and operatively connected to said first switching element, for applying the external voltage to said first switching element;

a third switching element operatively connected between said pulse input terminal and said first switching element;

a first resistor operatively connected between said third switching element and said pulse input terminal; and a second resistor operatively connected between said pulse input terminal and ground.

6. A power supply circuit according to claim 4, wherein said voltage regulator circuit, comprises:

a third switching element operatively connected to said first switching element;

a first resistor operatively connected to said third switching element and said output terminal;

a second resistor operatively connected to said first resistor, said third switching element and ground, forming a voltage divider with said first resistor for supplying a voltage to said third switching element;

a third resistor operatively connected to said first switching element and said third switching element; and a diode operatively connected between said third resistor and ground.

7. A power supply circuit according to claim 6, operatively connectable to receive an external voltage, further comprising:

a fourth switching element operatively connected to said third and first switching elements and ground;

a pulse input terminal, operatively connected to receive the external voltage and operatively connected to said fourth switching element, for applying the external voltage to said fourth switching element;

a fourth resistor operatively connected between said fourth switching element and said pulse input terminal; and a fifth resistor operatively connected to said pulse input terminal and ground.

8. A power supply circuit, comprising:

a first power source terminal operatively connected to a first voltage which is a positive voltage;

a second power source terminal operatively connected to a second voltage opposite in polarity to said first voltage;

a reference terminal operatively connected to a reference voltage;

a load operatively connected to said first power source terminal;

resistor means, operatively connected in series between said first and second power source terminals, for controlling the application of said first and second voltages;

a first diode operatively connected to said second power source;

a second diode operatively connected to said first diode and operatively connected between said reference terminal and said second power source;

first and second output terminals, said second output terminal operatively connected to said second diode and said first output terminal operatively connected to said first power source terminal;

first switching means having a first control terminal and operatively connected to said first power source terminal, for switching the voltage levels at said first output terminal;

second switching means having a second control terminal operatively connected to said resistor means, operatively connected between said first control terminal of said first switching means and said reference terminal, for switching on and off said first switching means, said resistor means including means for applying said second voltage to said second power source terminal, for turning on said first switching means, said resistor means including means for cutting-off said second voltage from said second power source terminal, for turning off said first switching means before the voltage level of said second output terminal rises to the reference voltage, said resistor means including means for applying said first voltage to said first output terminal before said second voltage is applied to said second output terminal, independent of the order in which said first and second voltages are applied to or cut-off from said first and second power source terminals, respectively; and a capacitive element, operatively connected between said second power source terminal and said reference terminal, for providing a time delay to said second output terminal.

* * * * *

UNITED STATES PATENT AND TRADEMARK OFFICE

CERTIFICATE OF CORRECTION

PATENT NO. : 4,459,538

DATED : JULY 10, 1984

INVENTOR(S) : YOUICHI ARAI ET AL.

It is certified that error appears in the above-identified patent and that said Letters Patent is hereby corrected as shown below:

Col. 1, line 13, after ".", continue with line 14, with no paragraph indentation;
line 29, "to voltage" should be --voltage to--;
line 32, ""off" and" should be --"off", and--;
line 59, "having" should be --having;--.

Col. 2, line 14, "is" should be --is a--;
line 40, "+15" should be --+15V--;
line 41, delete "V".

Col. 3, line 2, "is Shown" should be --is shown--.

Col. 4, line 38, "delay on" should be --delay. On--.

Col. 5, line 3, delete "of" (first occurrence);
line 21, "respectively" should be --respectively,--;
line 30, delete "state";
line 48, "division" should be --division,--;
line 49, "voltage" should be --voltage,--.

UNITED STATES PATENT AND TRADEMARK OFFICE

CERTIFICATE OF CORRECTION

PATENT NO. : 4,459,538

DATED : JULY 10, 1984

INVENTOR(S) : YOUICHI ARAI ET AL.

It is certified that error appears in the above-identified patent and that said Letters Patent is hereby corrected as shown below:

Col. 6, line 42, "one directional" should be --one-directional--;
line 49, "one" should be --one- --.

Col. 7, line 18, delete "poten-";
line 19, "tial" should be --voltage--; and "voltage" should be --potential--.

Signed and Sealed this

*Twenty-second* Day of *January 1985*

[SEAL]

*Attest:*

DONALD J. QUIGG

*Attesting Officer* *Acting Commissioner of Patents and Trademarks*